US005216778A

United States Patent [19]

Suzuki et al.

[11] Patent Number: 5,216,778

[45] Date of Patent: Jun. 8, 1993

[54] VACUUM CLEANER

[75] Inventors: Naruhiko Suzuki, Hitachi; Akira Iwao, Kitaibaraki; Yoshitaro Ishii, Hitachi; Masao Sunagawa, Hitachi; Yasuyuki Hiruta, Hitachi, all of Japan

[73] Assignee: Hitachi, Ltd., Tokyo, Japan

[21] Appl. No.: 845,839

[22] Filed: Mar. 6, 1992

Related U.S. Application Data

[63] Continuation of Ser. No. 543,397, Jun. 26, 1990, abandoned.

[30] Foreign Application Priority Data

Jun. 30, 1989 [JP] Japan ..... 1-166678

[51] Int. Cl.[5] ..... A47L 9/24

[52] U.S. Cl. ..... 15/327.1; 15/377; 174/47; 285/7; 439/194

[58] Field of Search ..... 15/327.1, 377; 174/47; 285/7; 439/194, 195

[56] References Cited

U.S. PATENT DOCUMENTS

| | | | |
|---|---|---|---|
| 2,769,997 | 11/1956 | Sheahan | 15/377 |
| 3,002,216 | 10/1961 | Beach | 15/327.1 |
| 3,127,227 | 3/1964 | Edwards | 439/195 |
| 3,636,285 | 1/1972 | Wickham et al. | 15/327.1 |
| 4,597,130 | 7/1986 | Lyman | 15/327.1 |

FOREIGN PATENT DOCUMENTS

| | | | |
|---|---|---|---|
| 1069274 | 5/1967 | United Kingdom | 174/47 |
| 1440866 | 6/1976 | United Kingdom | 439/194 |

*Primary Examiner*—Harvey C. Hornsby
*Assistant Examiner*—Mark Spisich
*Attorney, Agent, or Firm*—Antonelli, Terry, Stout & Kraus

[57] ABSTRACT

An electric vacuum cleaner having a body, suction generating means and a dust collection space in said body, and a rotatable hose inlet for receiving a suction hose and connecting the hose to the dust collection space. The suction hose has at one end a coupling engageable with said hose inlet. An electrical power supply cord socket is arranged to receive a plug of a power supply cord for a powered accessory of the vacuum cleaner. To avoid twisting of the cord around the hose, the cord socket is located on the hose coupling.

12 Claims, 13 Drawing Sheets

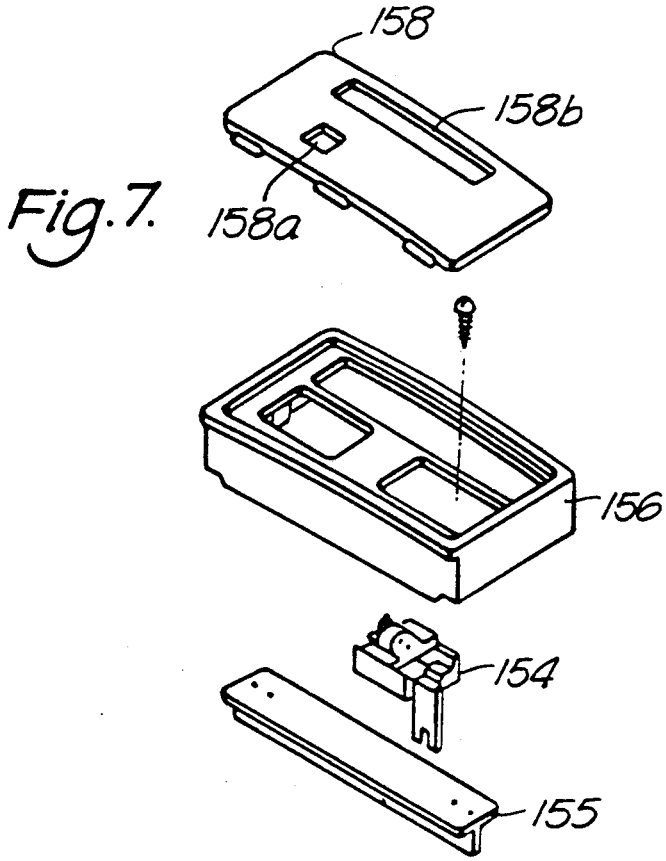
Fig. 7.
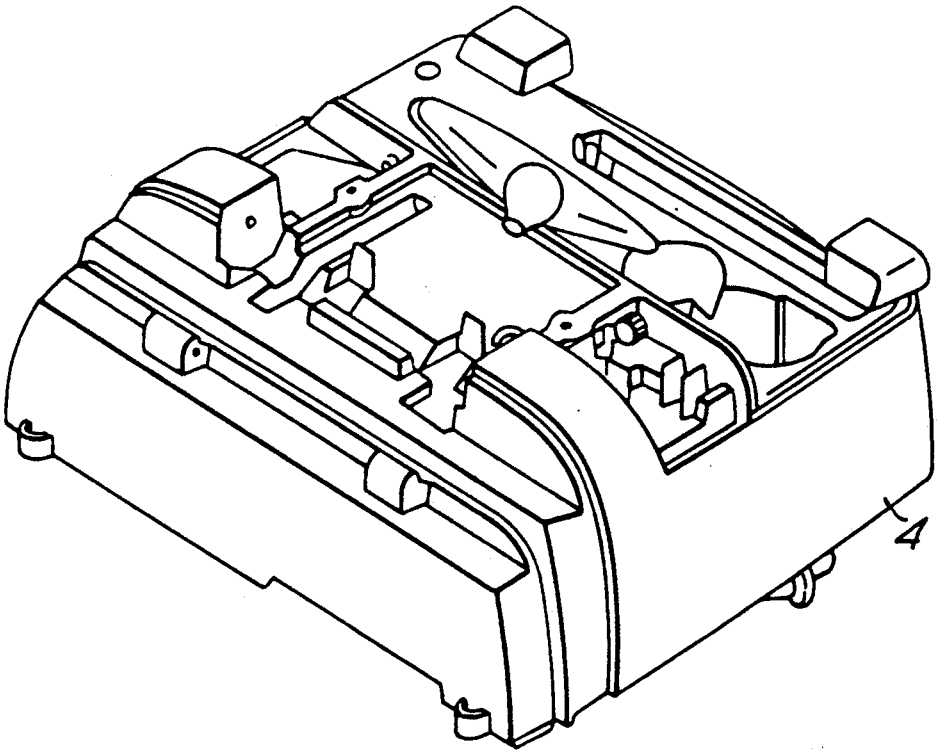

Fig. 17.
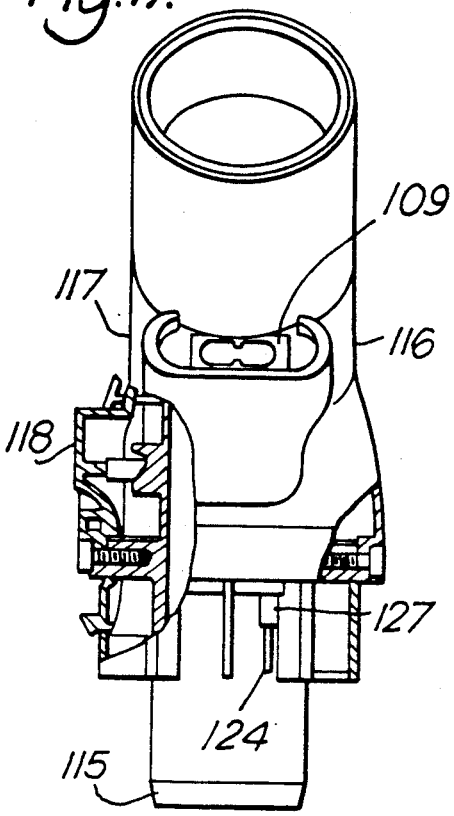
Fig. 18.
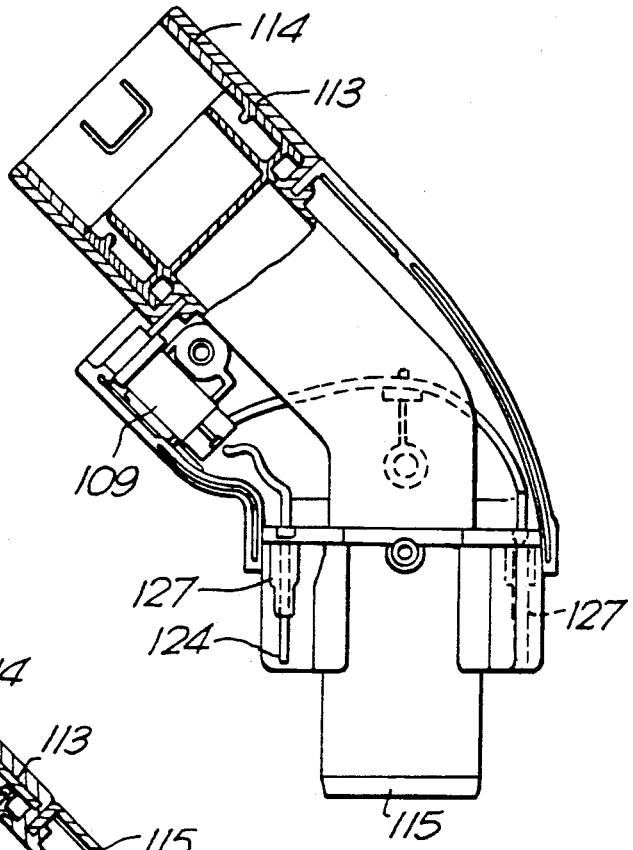
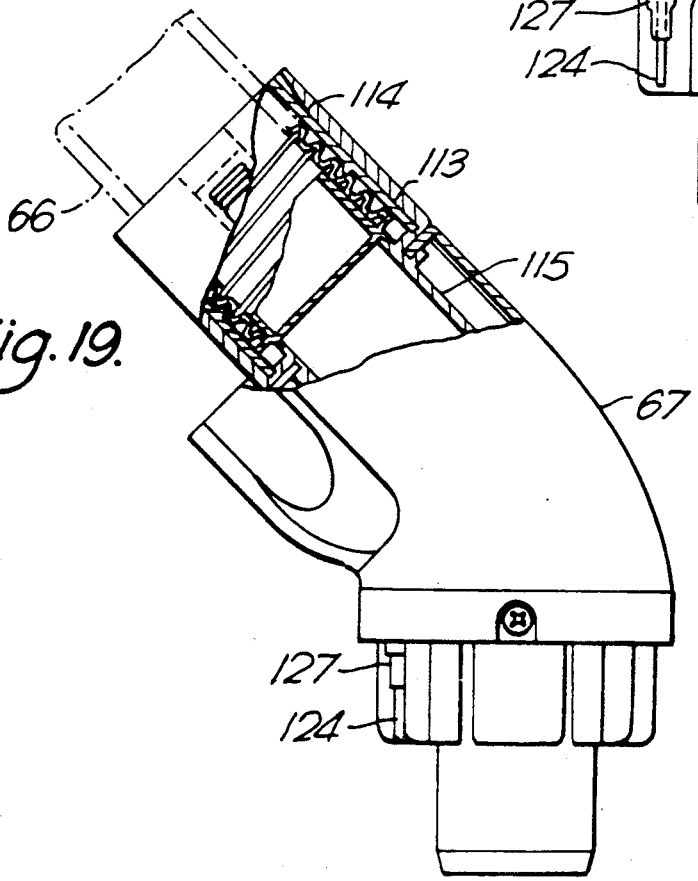
Fig. 19.

VACUUM CLEANER

This application is a continuation application of application Ser. No. 07/543,397, filed Jun. 26, 1990 now abandoned.

BACKGROUND OF THE INVENTION

1. Field of the Invention

This invention relates to vacuum cleaners, particularly electric vacuum cleaners.

2. Description of the Prior Art

Electric vacuum cleaners have been highly developed in recent years, and many different models have been placed on the market. Vacuum cleaners for use in the home are generally of two types, often known as the cylinder type and the upright type. The cylinder type has a body, usually mounted on wheels, and containing an electric motor driven suction generating means such as a fan and a dust collection chamber in which usually dust collection bags are mounted to filter the sucked air. The air is sucked through a hose from a cleaning accessory such as a brush or a nozzle at the remote end of the hose. The hose has a coupling detachably connectable to a hose inlet leading to the dust collection chamber. Cleaning is conducted by moving the accessory over the surface to be cleaned.

The upright type differs in that the surface to be cleaned is located immediately beneath the body, so that a hose and an accessory are not required. Nevertheless the upright type is usually adaptable so as alternatively to suck air through a hose from a remote accessory. The upright type has the advantage that the body may also carry one or more brushes which are driven in rotation, and which contact the surface to be cleaned which is particularly advantageous when cleaning carpets.

Recently, in order to provide the same advantage in a cylinder type vacuum cleaner, there has been provided an accessory for mounting at the end of the hose, which itself has one or more rotating brushes for contacting the surface being cleaned. An electric motor mounted in the accessory rotates the brush or brushes. To supply electric power to this accessory, a cord or lead may be arranged inside the hose. The hose coupling engageable with the hose inlet and the hose inlet itself have a plug and socket arrangement for connecting this lead to electrical power source in the vacuum cleaner body. Safety requirements in some countries may not permit this arrangement. In that case, the electrical supply cord for the powered accessory must be located outside the hose, and a socket is provided on the vacuum cleaner body for insertion of a plug at one end of the cord. An example of the latter arrangement is shown in JP-A-58-49128, in which the power supply socket is arranged in the upper surface of the vacuum cleaner body.

This power supply cord to the accessory is conveniently attached by clips to the hose, so that it does not trail and become entangled with the vacuum cleaner or furniture etc. However, in order to allow flexing or rotation of the hose portion near the body, there must still be a free portion of cord which can form a loop which is liable to catch on the user or on furniture. If the hose is rotatable relative to the body, the cord becomes twisted around the hose. It is an object of the present invention, in a first aspect, to solve this first problem.

Increasing sophistication of the control of electric vacuum cleaners means that such vacuum cleaners commonly include printed circuit boards. The printed circuit board may carry a small electrical device, e.g. a switch, which is operated by the user through a control member, such as a switch button. There is a risk of damage to the delicate printed circuit board and the small devices which it carries, if excess force is applied by the user to the control member. For example if the control member is on the top of the vacuum cleaner, there is a tendency for users to employ their feet rather than their hands to operate the control member. In a second aspect, it is an object of the invention to provide a solution to this second problem.

The electric motor in the body of a vacuum cleaner is commonly cooled by the sucked air, the motor being on the exhaust side of the fan. The flow rate of sucked air varies in inverse dependence on the degree of vacuum being generated by the vacuum cleaner. When a high vacuum is being generated, the airflow may not be sufficient to cool the motor adequately, which then overheats. To prevent this, it is known to provide a bypass valve for admitting external air directly to the sucked air path, when a predetermined level of vacuum is experienced. In this way, a greater airflow over the motor is achieved. There is a problem that the bypass valve currently used admits insufficient additional air to cool the motor adequately. In a third aspect, it is an object of the invention to overcome this third problem.

If a vacuum cleaner is operated without a bag correctly located in the dust collection chamber, firstly any dust sucked will be readmitted to the room, and secondly dust may enter the electric motor. In an attempt to prevent this, it is known to design the mounting means for the dust bag in the dust collection chamber so that an incorrectly located bag usually prevents closure of the cover, which is opened to give access for installation or removal of a bag. This does not prevent closure of the cover when no bag is present in the dust collection chamber. In an attempt to solve this problem, one vacuum cleaner has been marketed by Miele in which a mount for the bag is pivotable and is biased into the position in which it obstructs closure of the cover, unless a bag is mounted on it. The weight of the bag overcomes the bias and pivots the mount into a position where the cover can be closed. The empty bag is light, so that the spring which biases the pivotable mount must have only a light force. This raises a difficulty of design and of maintenance. In a fourth aspect it is an object of the present invention to provide an improved arrangement for preventing operation when no dust bag is present.

SUMMARY OF THE INVENTION

In its first aspect, the invention provides an electric vacuum cleaner having suction generating means and a dust collection space in a body and a hose inlet for receiving a suction hose and connecting the hose to the dust collection space. The suction hose has at one end a coupling engageable with said hose inlet, and an electrical power supply cord socket on the coupling to receive a plug of a power supply cord for an accessory of the electric vacuum cleaner. Especially when the coupling of the hose is rotatable relative to the body when received in the hose inlet, this location of the cord socket prevents entanglement of the cord with the hose.

It is preferred that the suction air flow path through the hose has a bend at the coupling, and the cord socket on the coupling is located at the inside of said bend.

In its second aspect the invention provides an electric vacuum cleaner having at least one control member operable by a user, and a printed circuit board including an electrical device mechanically operated by the control member. A load bearing member is arranged to resist force applied by the user to the control member and thereby prevent application of excess force to the electrical device on the printed circuit board. The load bearing member and the printed circuit board are preferably independently supported on a body casing of the vacuum cleaner.

In its third aspect, the invention provides an electric vacuum cleaner having an electric motor, suction generating means driven by said electric motor, and a suction path for suction air flow from a surface being cleaned by use of the vacuum cleaner to said suction generating means. The electric motor is cooled by air sucked by the suction generating means. These are provided by a plurality of spring-loaded bypass valves, arranged to operate in parallel, to admit additional external air to said suction path. Each bypass valve is arranged to open when the pressure in said suction path drops below a respective predetermined level.

Use of a plurality of bypass valves, rather than one valve as previously, gives a progressive or stepped increase in the bypass air admitted for cooling the motor, avoiding a sharp increase due to a large single valve and the complication of a variable flow valve.

In its fourth aspect the invention provides a vacuum cleaner having means for mounting a dust collection bag in a dust collection chamber, so that dust is filtered from sucked air by the bag, and a cover openable to provide access to the dust collection chamber for installation or removal of a dust bag. A releasable latch holds the cover in its closed position. An obstructor is mounted on the cover to prevent full closure of said cover when there is no bag correctly located at said predetermined position on said mounting means. The obstructor is movable between an operative position preventing operation of the latch on closure of said cover and an inoperative position permitting operation of the latch on closure of said cover. The obstructor is located so as to engage a correctly located dust bag during closure of the cover and be moved thereby to said inoperative position. This obstructor arrangement is simple and unobtrusive, and can be made strong enough to avoid damage if a user attempts to force the cover closed.

BRIEF INTRODUCTION OF THE DRAWINGS

An embodiment of the invention will now be described by way of non-limitative example with reference to the accompanying drawings, in which.

Figure 1:
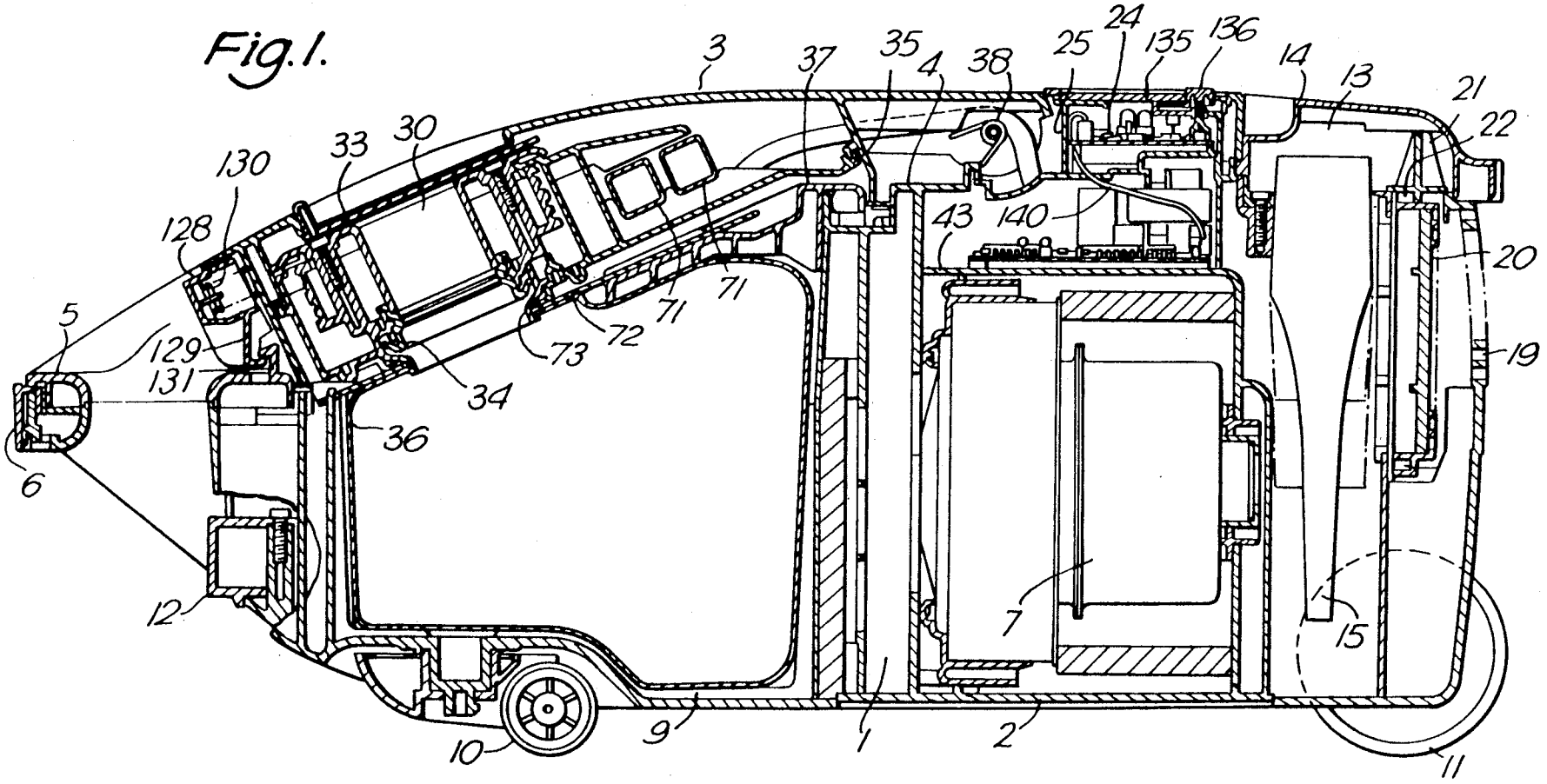
FIG. 1 is a general vertical sectional view, at a central longitudinal plane, of an electric vacuum cleaner of the cylinder type embodying this invention.
Figure 4A:
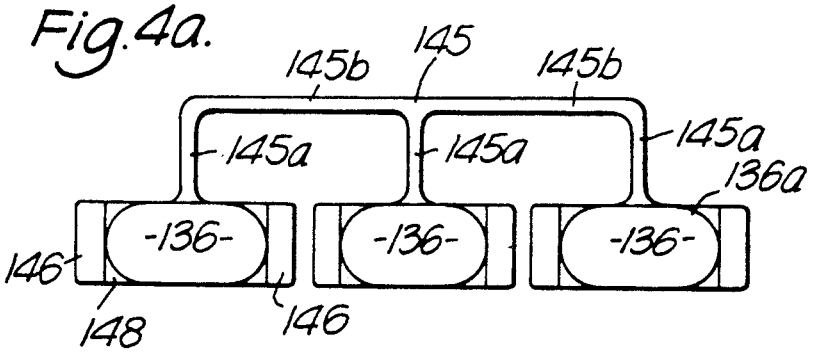
Figure 4B:
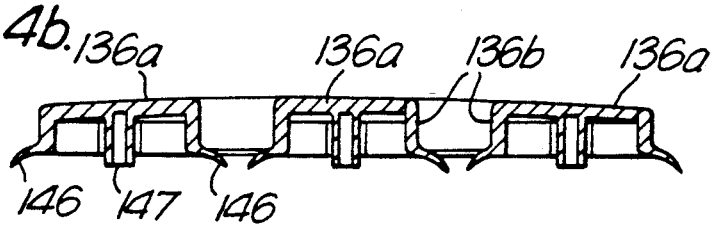
Figure 5:
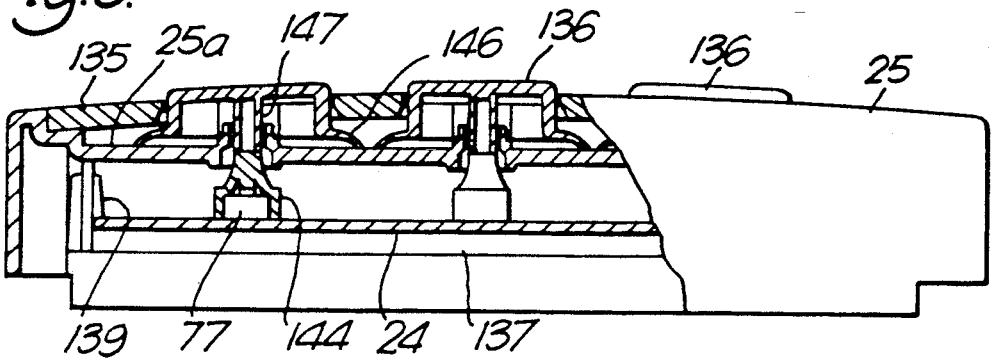
Figure 3:
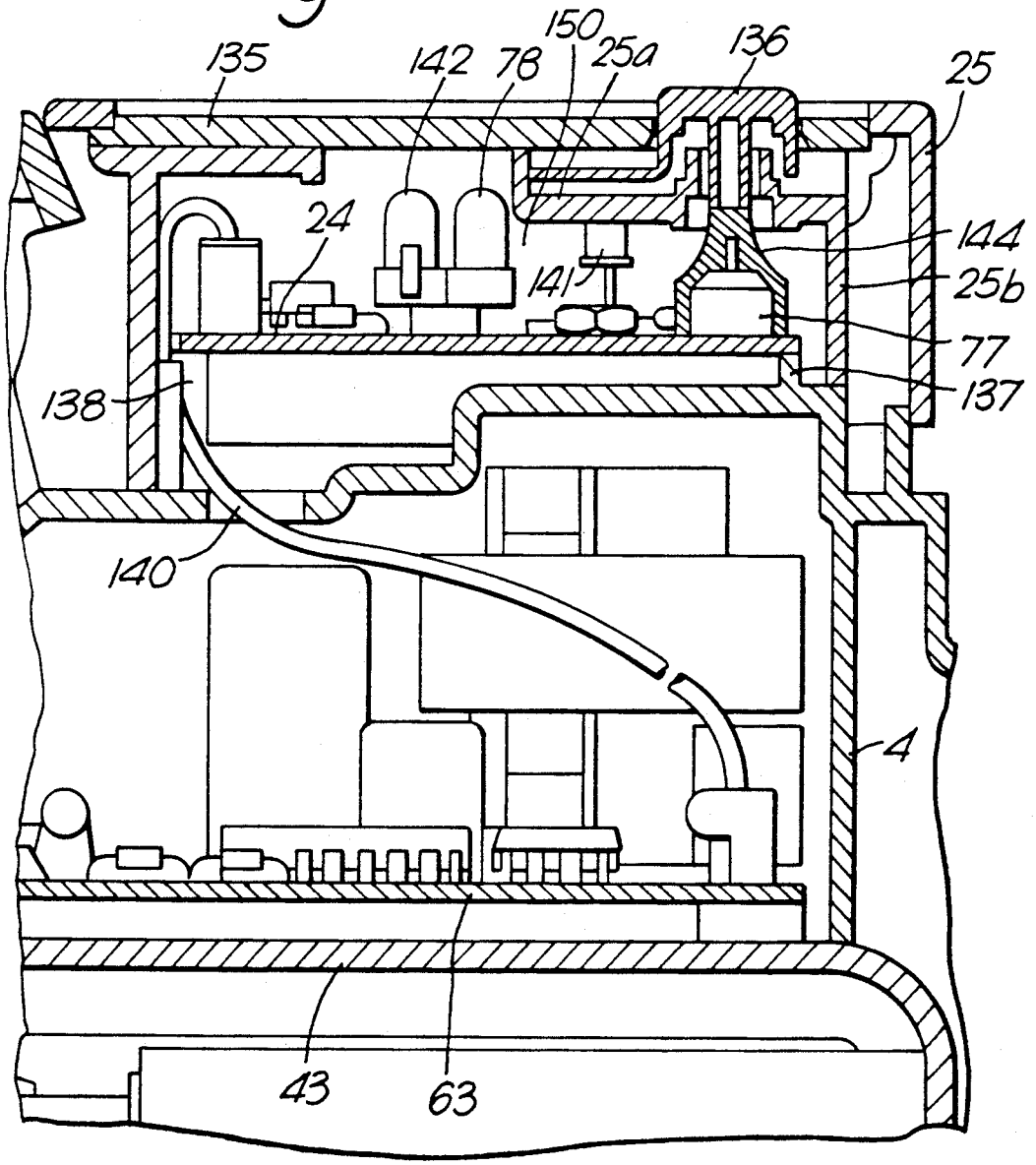
FIG. 3 is a small portion of the section of FIG. 1, much enlarged, showing a control button and a printed circuit board of the vacuum cleaner.
Figure 6:
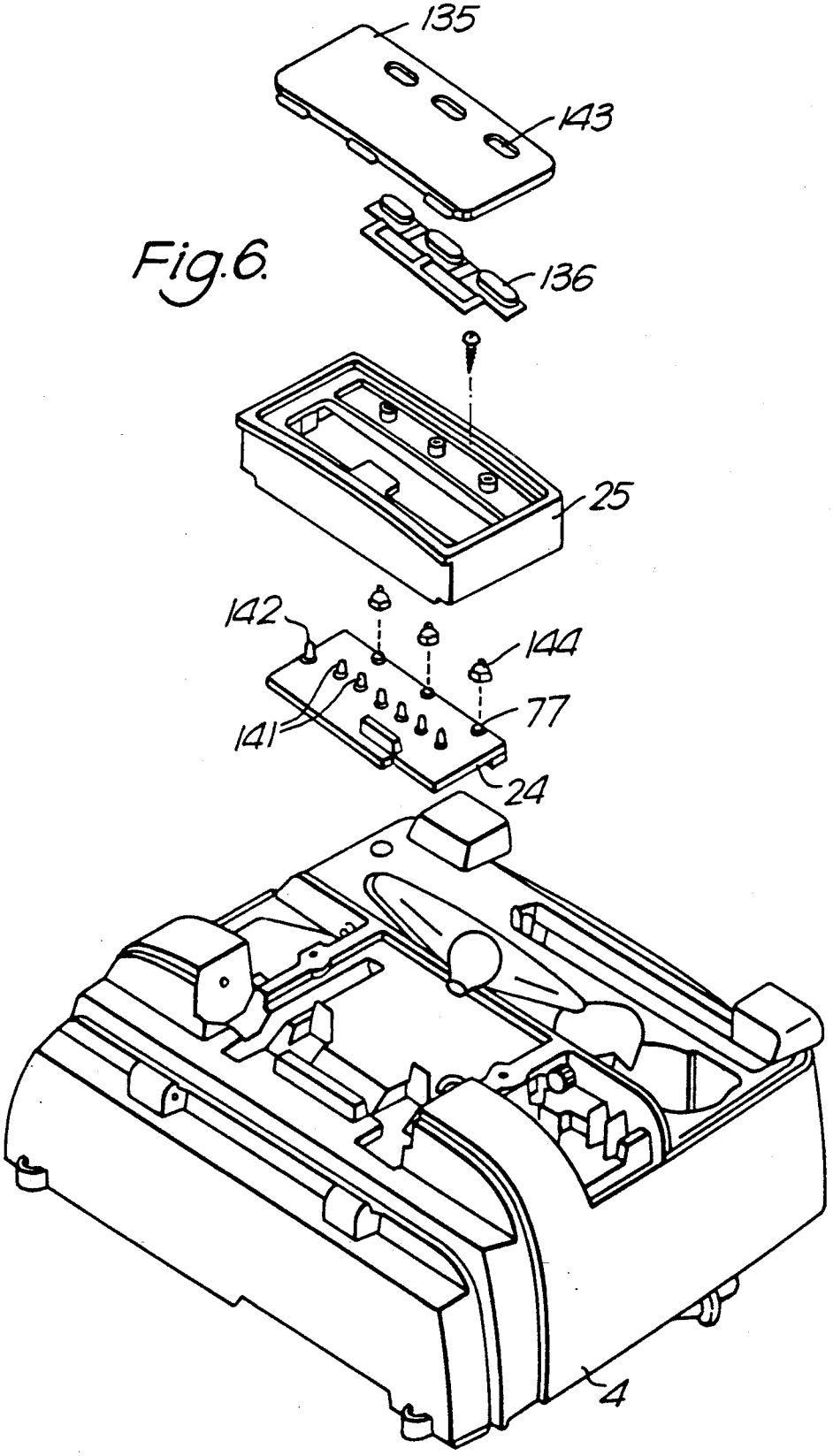
Figure 8:
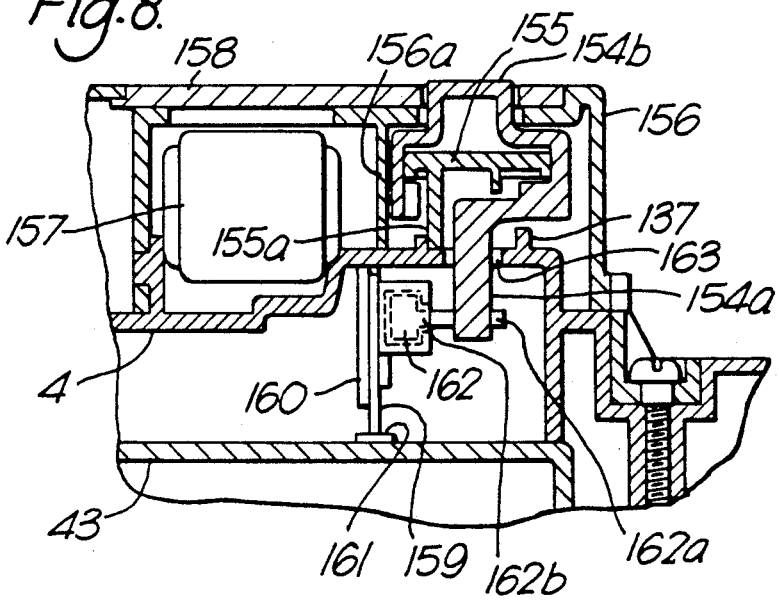
Figure 9:
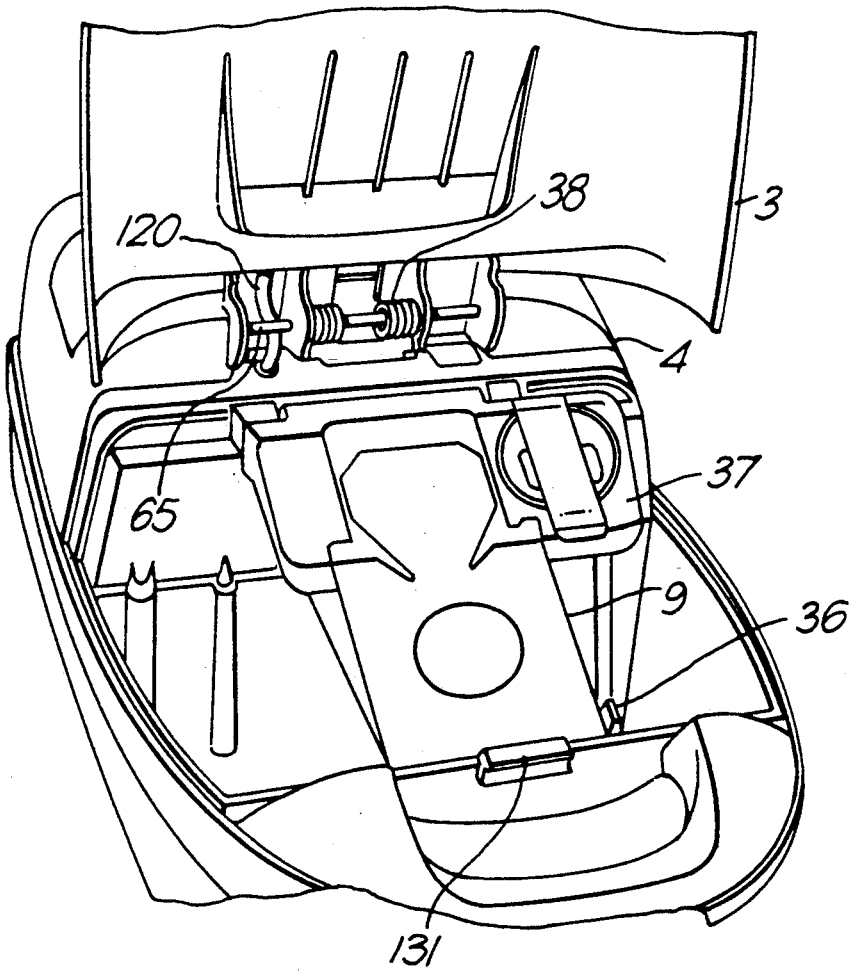
Figure 10:
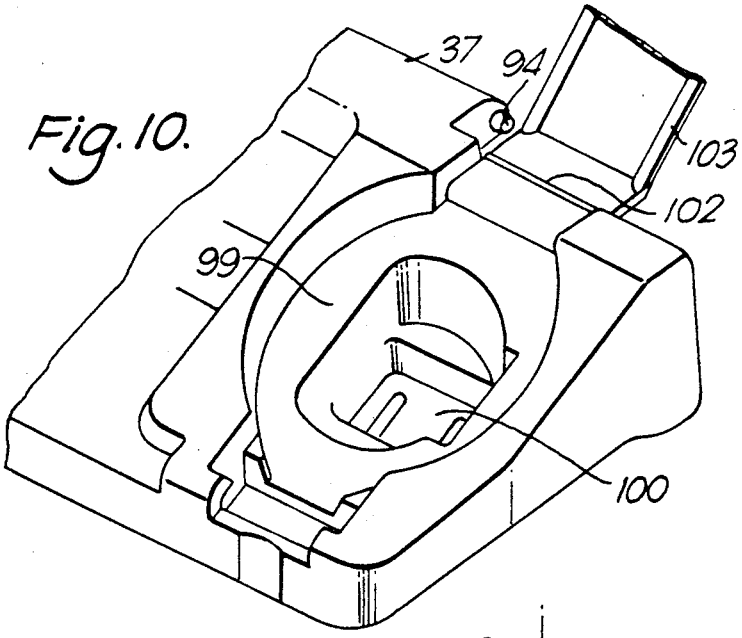
Figure 11:
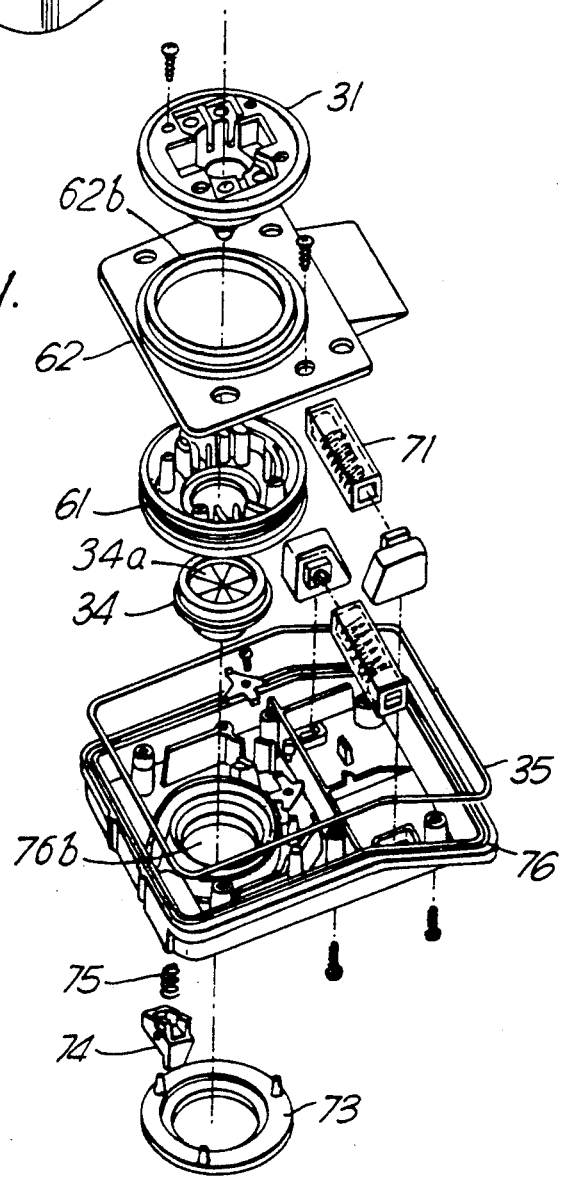
Figure 12:
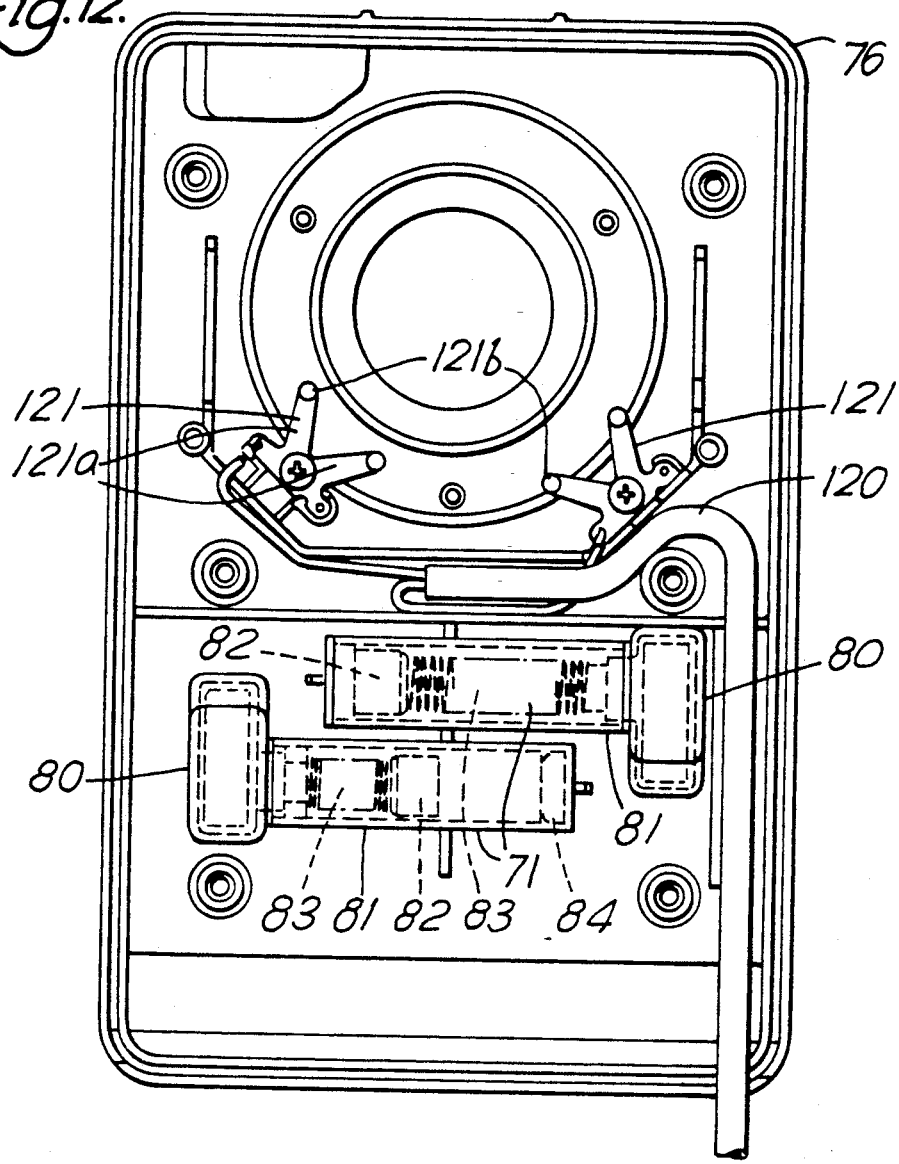
Figure 13:
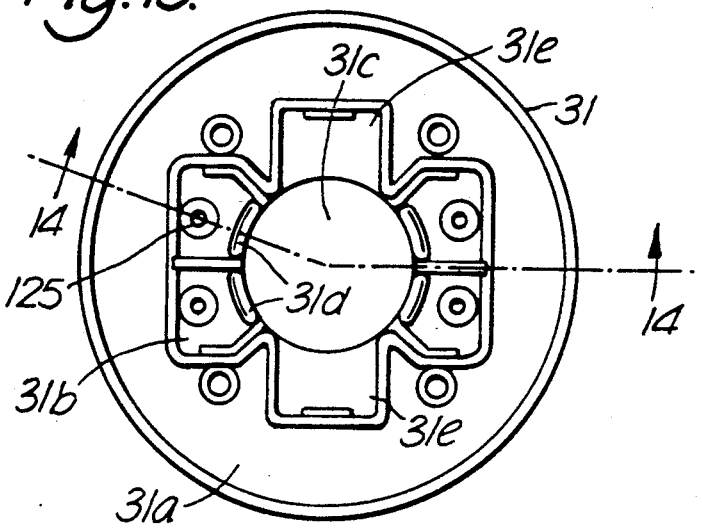
Figure 14:
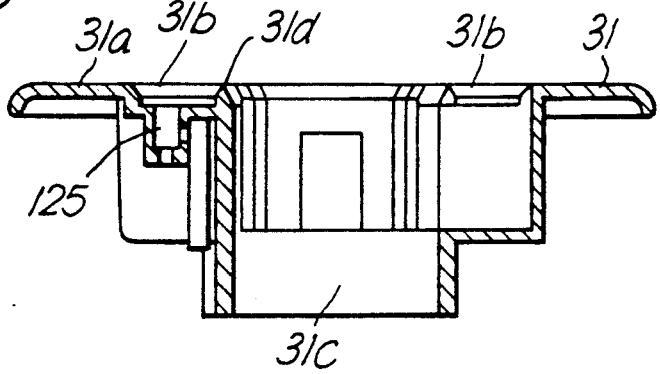
Figure 15A:
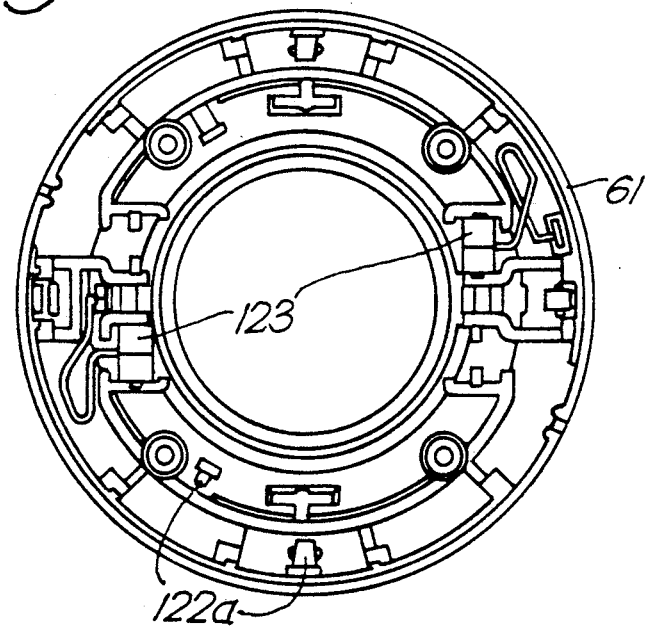
Figure 15B:
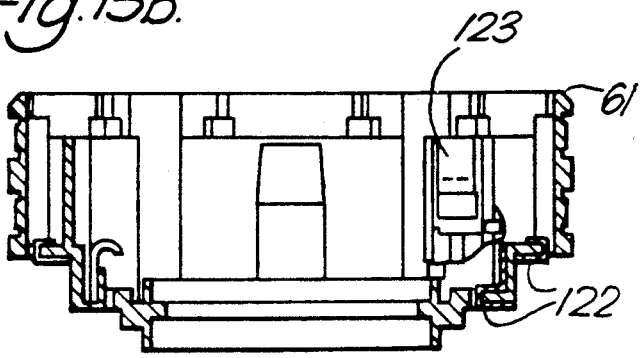
Figure 16:
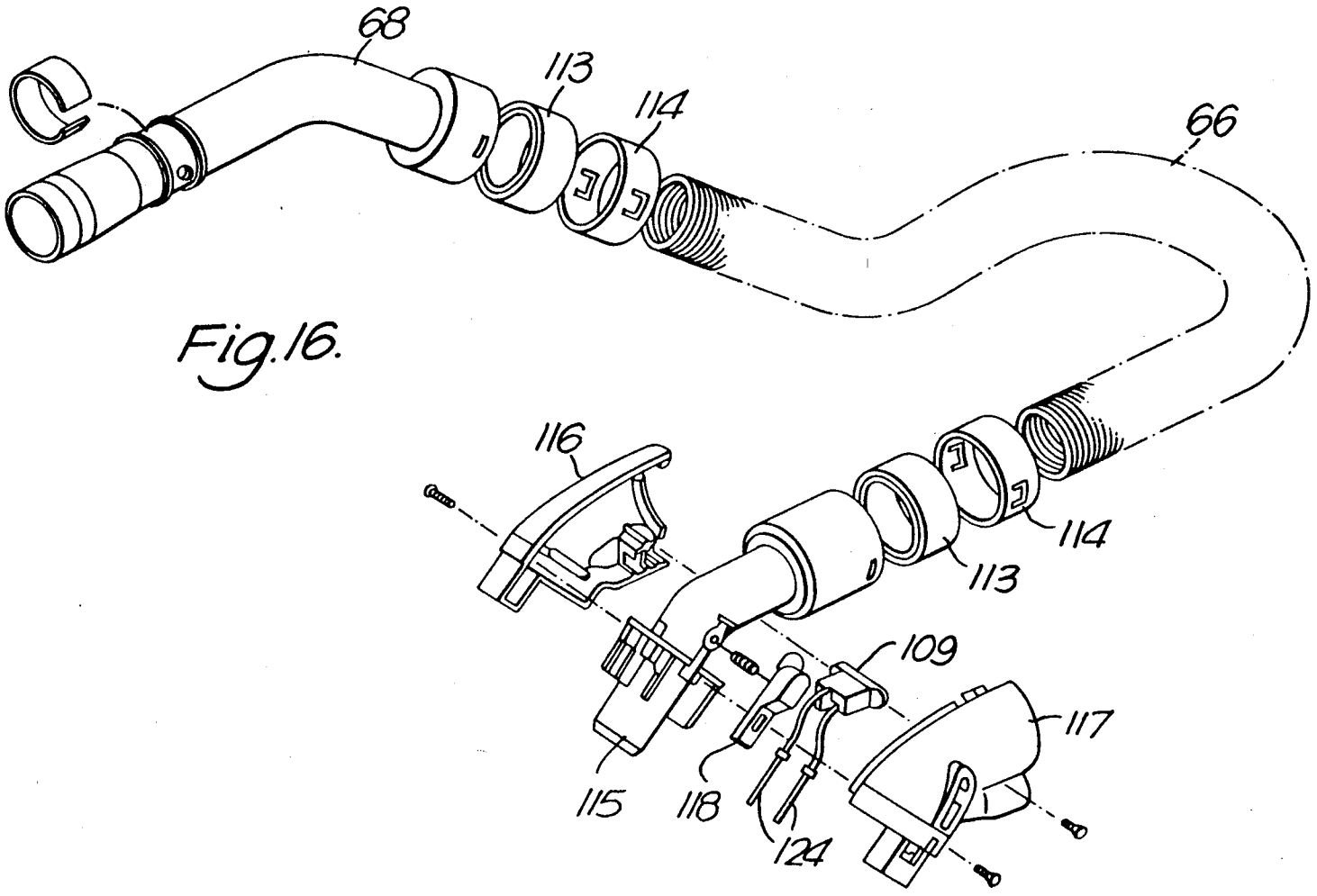
Figure 20:
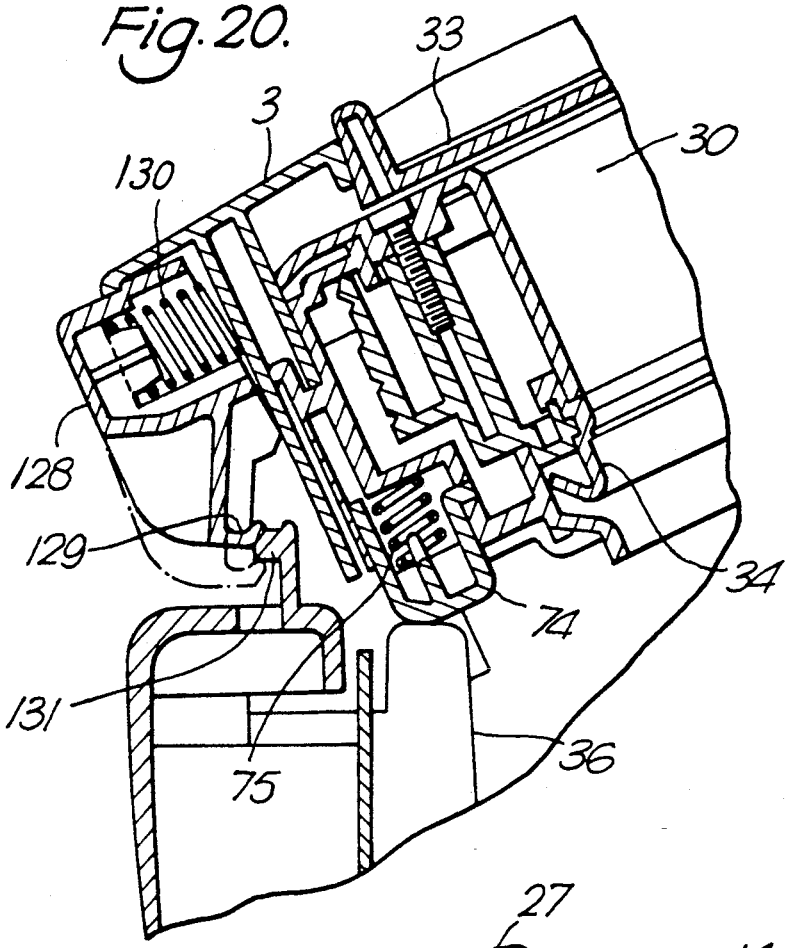
Figure 21:
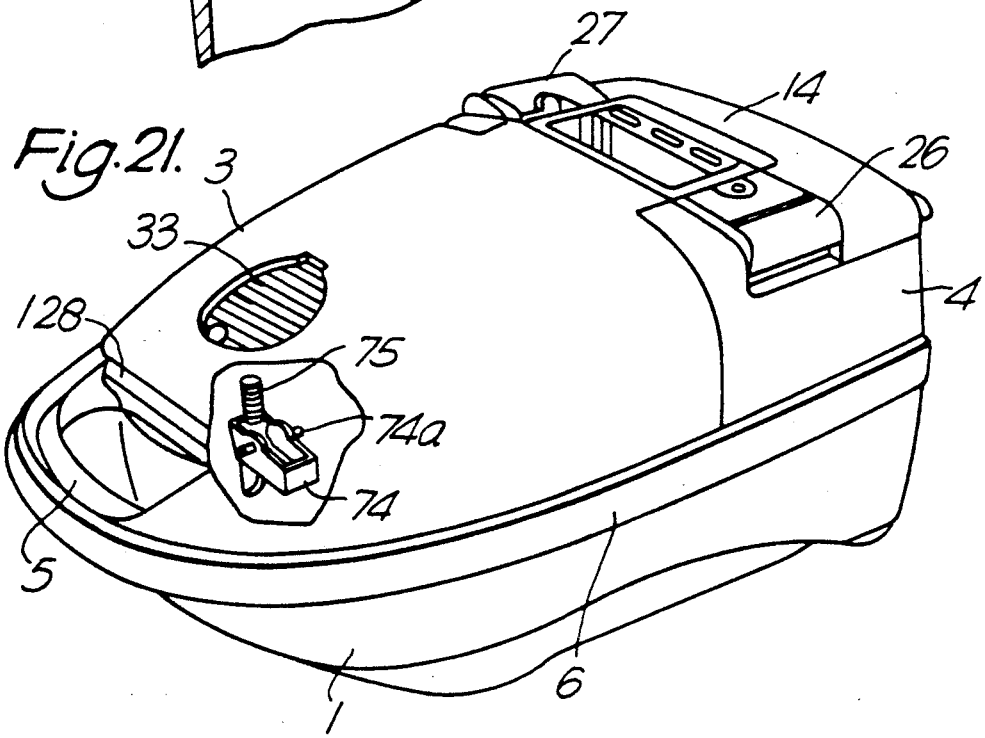
Figure 22:
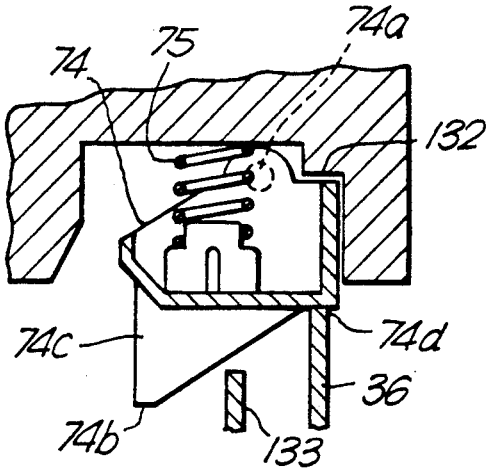
Figure 23:
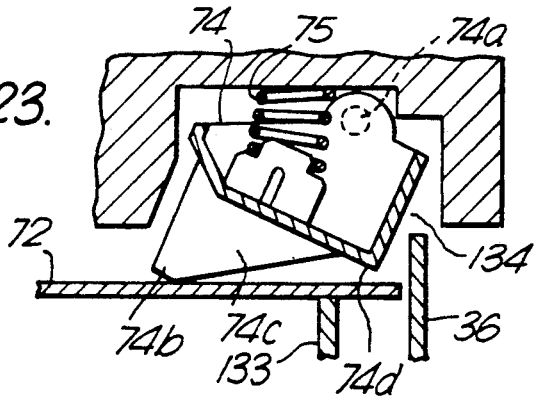
Figure 24:
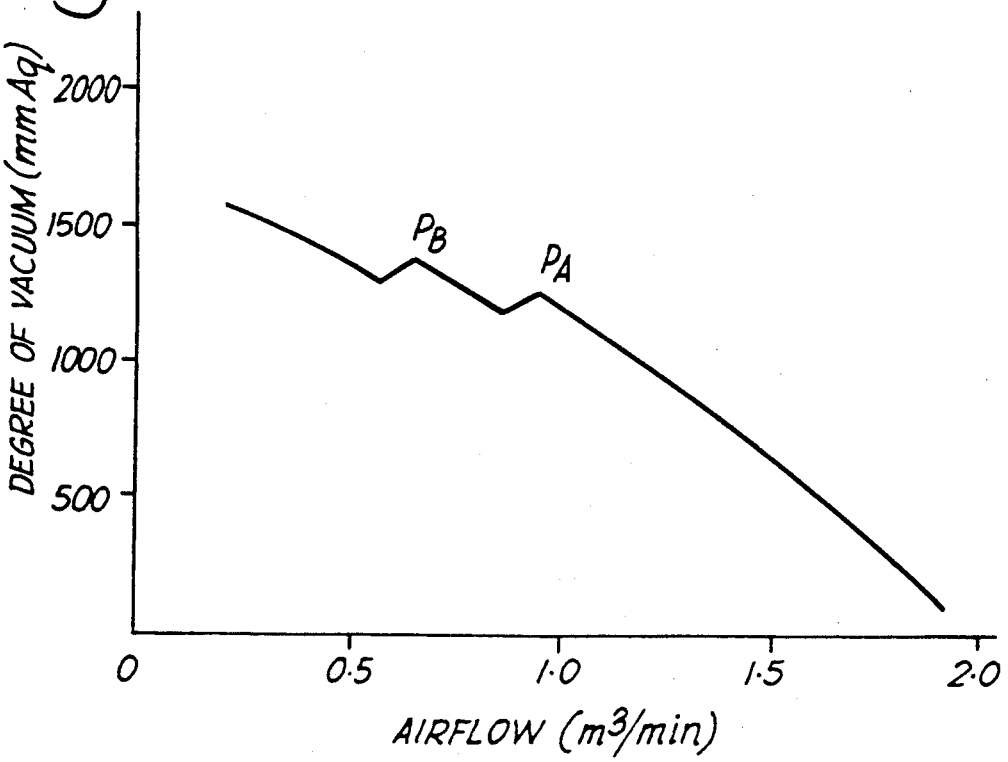

FIGS. 4*a* and 4*b* are respectively a plan view and a vertical sectional view of a control button unit of the vacuum cleaner of FIG. 1;

FIG. 5 is a vertical section, perpendicular to the section of FIG. 3, showing the button unit of FIG. 4 in place;

FIG. 6 is an exploded perspective view of a top cover part of the body of the vacuum cleaner of FIG. 1 together with several parts mounted thereon;

FIG. 7 is an exploded view corresponding to that of FIG. 6, in a modified version of the embodiment of FIG. 1;

FIG. 8 is a vertical section of a portion of the control parts illustrated in FIG. 7;

FIG. 9 is a perspective view of the vacuum cleaner of FIG. 1 with the dust chamber cover open;

FIG. 10 is a perspective view of part of a dust bag mount shown in FIG. 9;

FIG. 11 is an exploded perspective view of parts providing the hose inlet of the vacuum cleaner of FIG. 1;

FIG. 12 is a top plan view of an inner cover member shown in FIG. 11;

FIG. 13 is a top plan view of a socket part of the hose inlet of FIG. 11;

FIG. 14 is a vertical sectional view on the line 14—14 of FIG. 13;

FIG. 15*a* is a top plan view of a connector part of the hose inlet of FIG. 11;

FIG. 15*b* is a diametrical sectional view of the connector part of FIG. 15;

FIG. 16 is an exploded view of the hose of the vacuum cleaner of FIG. 1;

FIG. 17 is a rear view, partly in section, of the hose coupling of the hose of FIG. 16;

FIG. 18 is an axial section of the hose coupling of FIG. 17;

FIG. 19 is a side view, partly in section, of the hose coupling of FIG. 17;

FIG. 20 is an enlarged vertical section corresponding to part of FIG. 1, showing the dust chamber cover not fully closed;

FIG. 21 is a perspective view of the vacuum cleaner of FIG. 1 indicating diagrammatically the location of an obstructor;

FIGS. 22 and 23 are somewhat diagrammatic, partial sectional views, showing the arrangement and operation of the obstructor;

FIG. 24 is a graph illustrating the operation of the bypass valves of the vacuum cleaner of FIG. 1.

DESCRIPTION OF THE PREFERRED EMBODIMENT

In the following description, not all parts illustrated will be fully described, since many parts embody conventional technology and are not directly relevant to the inventive concepts which form the subject of this specification. The construction of such parts will not cause difficulty to the expert designer of vacuum cleaners. As is conventional, many of the parts of the vacuum cleaner are plastics mouldings.

The vacuum cleaner shown in FIG. 1 has a structural body 1 mounted on a front caster wheel 10 and two rear wheels 11 on fixed axes and comprising a lower casing 2 and a top casing 4 rigidly attached thereto. Pivotally mounted on the top casing 4 is a dust chamber cover 3 which carries a hose inlet 30. At the front of the body 1 there is a handle 5. A shock-absorbing furniture guard 6 extends around the front and sides of the body 1 at the level of the handle 5.

The body 1 encloses an electric blower 7 including an electric motor, a cord reel (not shown) for the winding up of a cord for supply of electric power to the vacuum cleaner from the mains and a dust collection bag 9 shown occupying a dust collection chamber. The cover 3 in its closed position closes the top of the dust collection chamber, and is pivotably openable as shown in FIG. 9 to allow insertion and removal of the bag 9.

At the front of the body 1, there is mounted a holder 12 for storing a hose extension tube. Close to the rear is a rack 13 for storing several small cleaning accessories, closed by a cover 14. The accessories received in this rack 13 are, for example, a crevice nozzle 15. At the rear is an air exhaust port 19. The suction air being exhausted passes to the port 19 through a filter 20 carried in a removable filter casing 21. To seal the filter casing 21 to the top casing 4, the filter casing 21 has a seal mounting recess 22 extending around its periphery. The seal is not shown.

On the top of the top casing 4 there is mounted a box 25 covering a printed circuit board 24 and having a top panel 135 through which switch operating buttons 136 project. Laterally of this box 25 (see FIG. 2), there are respectively a pivotable pedal switch 26 for turning on and off the power supply to the electric blower 7 and a pivotable pedal 27 for controlling the operation of the cord reel.

Figure 2:
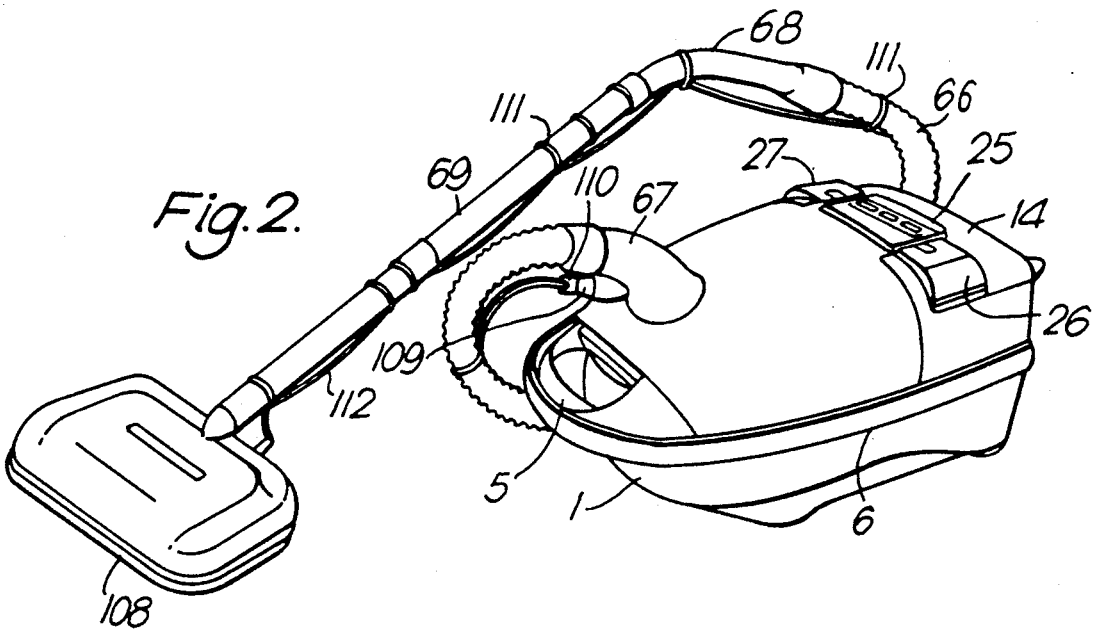
FIG. 2 is a perspective view of the vacuum cleaner of FIG. 1 with a suction hose and accessory attached to it.

FIG. 2 also shows a flexible suction hose 66 of conventional corrugated wall type having at its end remote from the cleaner body 1 a rigid extension tube 69 carrying at its remote end an accessory 108 which here is a powered accessory requiring a supply of electric power to it via the vacuum cleaner body 1. This powered accessory 108 is for example one including an electric motor driving a brush in rotation, particularly for use in cleaning carpets. At its other end, the hose 66 has a hose coupling 67 which is received by the hose inlet 30. The coupling 67 and the inlet 30 are described in more detail below.

FIG. 2 shows that the coupling 67 which is rotatable relative to the body 1, as also described below, has on it an electrical power socket 109 which receives a plug 110 at one end of an electrical power supply cord 112. The other end of the cord 112 has a socket which engages with a plug member on the accessory 108. The electrical supply cord 112 is typically a two-wire cord of a suitable type for the voltage and power required by the accessory 108. The cord 112 is clipped to the hose 66 and the extension tube 69 by clips 111.

It can be seen from FIG. 2 and more clearly from FIGS. 16 to 19 that the suction air passage through the coupling 67 has a bend in it. The socket 109 is located at the inside of this bend, i.e. at the concave side of this bend. This location protects the socket 109 due to the shape of the coupling 67. The socket 109 does not interfere with the handling of the coupling 67 when attaching it to or detaching it from the body 1.

Referring now to FIG. 3, this shows the circuit board 24 mounted on top of the top casing 4 on upwardly projecting ribs 137, 138. The printed circuit board 24 has a printed circuit upon it and carries a number of electrical and electronic devices, including several light emitting diodes (LEDs) such as a function indicating LED 141, dust indicating LEDs 142 and a power indicating LED 78. Also carried on the circuit board 24 are three micro-switches 77 surmounted by covers 144 through which they are operated by three buttons 136 projecting through apertures 143 (FIG. 6) in this panel 135. By operating the buttons 136, the user can control the mode of operation of the vacuum cleaner, for example high vacuum, low vacuum or automatic vacuum control. The LEDs 78, 142 are visible through translucent portions of the top panel 135 mounted in a window in the box 25. The LEDs 78, 141, 42 and the switches 77 occupy a space 150 above the printed circuit board 24.

FIGS. 3, 4 and 5 show that the three buttons 136 each have a top wall **136*a*, a peripheral skirt 136*b* and a central cylindrical boss 147 which engages the top of the cover 144 of the micro-switch 77, to operate the micro-switch 77 when the button 136 is depressed by the user. At the lower edge of the peripheral skirt 136*b* at each end of the button 136, there is an outwardly and downwardly curving resilient lip 146 of thin plastics. Also at the ends of the buttons 136, there are ledges 148 which prevent extraction of the buttons 136 through the apertures 143 in the panel 135**.

FIG. **4*a* shows that the three buttons 136 are connected together integrally by a branched elongate element 145 which has short portions 145*a* connected to the buttons 136 and transverse longer portions 145*b* connecting the short portions 145*a*. The purpose of this elongate element 145 is to hold the buttons 136 relative to each other in their appropriate locations for insertion through the apertures 143 in the panel 135, during assembly of the vacuum cleaner. It can be seen from FIGS. 4*b* and 5 that the panel 135 is not planar, and that the top surfaces of the buttons 136 are correspondingly shaped so that the buttons project by uniform amount through the three apertures 143. This is done to achieve a good visual effect. The elongate element 145 means that the person assembling the vacuum cleaner is aided in placing the buttons 136 correctly in the apertures 143 in the panel 135. The elongate element 145 is flexible to allow the buttons 136** to be independently depressed during use of the vacuum cleaner.

The box 25 includes a load bearing member **25*a* of flat bar shape for the buttons 136. The member 25*a* is relatively rigid and is integral at its opposite ends and at one side with the box 25. It has a downward rib 25*b* by which it is supported on the top casing 4 independently of the support ribs 137, 138 for the printed circuit board 24. Additionally the top casing 4 has ribs 139 (FIG. 5) supporting the ends of the member 25*a*. The lower ends of the lips 146 of the buttons 136 contact the top surface of the load bearing member 25*a*. When the buttons 136 are depressed, the lips 146 flex resiliently, so that when the button 136 is released the lips 146 provide a resilient restoring force for the return movement of the button 136 to its rest position. The lips 146 allow sufficient movement of the button 136 to actuate the micro-switch 77 before the lower ends of the peripheral skirts 136*b* of the button 136 engages the load bearing member 25*a* to prevent any further depression of the button 136. Any excess load applied by the user to the button 136, over that needed to flex the lips 146 fully, is accommodated by the load bearing member 25*a* and not transmitted to the micro-switch 77 and the circuit board 24. Thus the delicate micro-switch 77 and the even more delicate circuit board 24** and its wiring and components are protected from the application of excess force which might damage them.

FIG. 3 shows a second printed circuit board 63 mounted on an internal wall 43. This is the main control circuit board for the electric motor of the vacuum cleaner, and is connected to the printed circuit board 24 by wiring 140.

FIGS. 7 and 8 show a modified form of the vacuum cleaner of FIG. 1 in which the parts relating to the three switch buttons 136 and the associated printed circuit board 24 of FIGS. 3 to 6 are replaced by parts providing a continuously variable manual control of the power supplied to the electric blower of the vacuum cleaner. As FIG. 8 shows, a vertically oriented printed circuit board 159 is mounted on a rib 160 formed on the top casing 4 of the vacuum cleaner body 1 and on a rib 161 on the internal wall 43. The printed circuit board 159 carries a variable resistance slider 162 extending perpendicularly to the plane of FIG. 8, which is operated by a slide lever 162*a* extending through a slot 162*b* in the housing of the slider 162. The lever 162*a* is located in a notch in a downwardly projecting leg 154*a* of a control member 154 which has a control knob 154*b*. The control member 154 is slidably mounted on a flat bar 155 constituting a load bearing member supported by a downwardly projecting flange 155*a* on the top casing 4. Thus support of the bar 155 is independent of the support of the printed circuit board 159. As FIG. 8 shows, the control member 154 embraces the horizontal bar 155 so as to be guided and retained thereby. The user pushes the knob 154*b* to slide the control member 154 along the bar 155, thereby moving the lever 162*a* of the slider 162, to vary the power supplied to the vacuum cleaner blower motor. The rigid bar 155 prevents excess force applied to the knob 154*b* from being transmitted to the slider 162.

The knob 154*b* projects through a slot 158*b* in a top panel 158 which is received in the top of a protective box 156 corresponding to the box 25 described above. The panel 158 also has a window 158*a*, or a corresponding transparent portion, through which an indicator 157 mounted in the box 156 may be viewed. The panel 158 may also contain signs corresponding to the positions of the knob 154*b* along the slot 158*b*, to indicate the operating condition of the vacuum cleaner. The box 156 contains a central partition 156*a* supported on the top casing 4 and separating the control member 154 from the indicator 157.

The leg 154*a* of the control member 154 moves in a slot 163 punched in the top casing 4. In order to prevent dust penetrating through the slot 163 to the printed circuit board 159, this dust having entered through the slot 158*b* in the cover 158, the downward flange 155*a* of the bar 155 acts as a seal on one side of the slot 163. At the other side of the slot 163 there is a short rib 137 extending upwardly from the top casing 4, to divert dust away from the slot 163. Thus there will be little tendency for dust to pass through the slot 163, even when the cleaner is picked up by its handle 5. For the same reason, the slot 162*b* of the slider 162 is not directly beneath the slot 163, and is arranged so that when the cleaner is picked up by the handle 5, dust tends to fall out of the slot 162*b* rather than pass through it into the interior of the slider 162.

FIG. 9 shows the cover 3 of the dust collection chamber in its open position, and shows a pivot bar 65 of the cover and a spring 38 which biases the cover around the pivot bar 65 into this open position. An electrical lead 120 is shown passing the hinge. This lead 120 supplies electrical power to the socket arrangement at the hose inlet 30 to be described below. The lead 120 must be of a suitable type and quality to meet safety requirements and to withstand its flexing during opening and closing of the cover 3.

In the dust collection chamber there is a hinged mount 37, also shown in FIG. 10, for the dust bag 9. FIG. 10 shows that this mount 37 is hinged on pivot pins 94 and includes a recess 99, 100 to receive deodorant or disinfectant packets. A cover 103 of the recess is hinged at 102 and in its closed position partially covers the recess 99, 100. The recess has a circular portion 99 and a rectangular portion 100.

FIG. 9 shows that the dust bag 9 has a cardboard face plate 72, which, when the bag 9 is correctly located as shown, lies upon the mount 37 at one side of the dust collection chamber, and as shown in FIG. 1, lies upon a support rib 133 (not shown in FIG. 9, see FIG. 22) at the other side of the dust collection chamber. Adjacent one edge of the face plate 72 is a rib 36 of the body 1 which projects into the dust collection space and has its top end above the level of the face plate in its mounted position. The top of this rib 36 forms an abutment surface for an obstructor 74 mounted on the cover 3, which will be described below (FIGS. 21 to 23). The cover 3 is held in its closed position by a releasable latch having a hook member 131 on the body 1 and a sprung catch member 129 on the cover 3 (see FIGS. 1 and 20).

FIGS. 11 to 16 show the hose inlet 30 which is mounted on the cover 3. FIG. 11 shows that the cover 3 has an inner cover 76 with an aperture 76*b* secured to its inner face and enclosing and supporting the hose inlet 30. A seal 35 seals between the inner cover 76 and the cover 3. Fixed on the inner cover 76 is a support plate 62 having a central aperture. Surrounding the central aperture is a bearing 62*b* for the rotatable parts of the inlet 30 which are (i) a hose receiving socket member 31 mounted on one side of the plate 62, (ii) an electrical connection member 61 secured to the socket member 31 and located on the other side of the plate 62 from the socket member 31 and (iii) a rubber seal 34 which is held in the central aperture of the connection member 61 and seals against the periphery of the aperture 76*b* in the inner cover 76. The seal 34 has a central passage which is closed by triangular flexible rubber flaps 34*a* which are moved aside when the hose connector 67 is inserted.

The aperture 76*b* in the inner cover 76 is bounded by wall which projects into the dust bag 9, when the cover 3 is closed. A rubber seal 73 mounted on the inside face of the inner cover 76 assists in the sealing of the cover 3 to the bag 9.

FIG. 12 shows that, adjacent to the aperture 76*b*, there are mounted two contacts 121 in the inner cover member 76. Each contact 121 consists of a pair of contact arms 121*a* terminating in contact surfaces 121*b*. These contacts 121 are connected to respective wires of the lead 120 mentioned above. The lead 120 is connected to a suitable power source in the vacuum cleaner body.

It is mentioned now that FIGS. 11 and 12 also show the two bypass valves 71 which will be described further below.

FIGS. 16 to 19 show the coupling 67 at the end of the hose 66, which has a projecting nozzle 115. When the coupling 67 is received in the hose inlet 30, the nozzle 115 penetrates through the central aperture of the inlet 30 to the interior of the dust bag 9.

FIGS. 13 and 14 show the hose receiving socket member 31 which has a central aperture 31*c*. There are two rectangular recesses 31*e* on each side of the central aperture 31*c* which receive corresponding lugs on the coupling 67. Also on the coupling 67 are two electrical connection pins 124 which are received in correspondingly located stepped apertures 125.

FIGS. 15 and 16 show that the electrical connection member 61 has contacts 123 to engage the pins 124 when they are inserted through the apertures 125. The contacts 123 are connected to respective slip rings 122 which are in the form of continuous stamped metal rings having projecting lugs 122*a* which are bent round to hold the slip rings 122 in place. Both slip rings 122 face axially, and are located at levels corresponding to the positions of the fixed contacts 121 in the inner cover 76 described above, so that the contacts 121 engage the slip rings 122.

The top openings of the apertures 125 in the member 31 are at the bases of recesses 31*b* in its top rim surface 31*a*, which are recessed by 3 mm from the top surface 31*a*. The aperture 125 corresponds in shape to a protective insulating sleeve 127 surrounding the pin 124 on the hose coupling to provide appropriate insulation. The arrangement is such that the leading end of the sleeve 127 has entered the aperture 125, when the leading end of the pin 124 comes into contact with the contact 123. This prevents a user touching the pin 124 while it is electrically live. The recesses 31*b* also improve the strength of the moulded part. The recesses 31*b* also have four rib shaped projections 31*d* at the same height as the surface 31*a* at the rim of the socket member 31. This causes the connector 67 to be fitted into the socket member 31 in the correct position to prevent bending or breakage of the pins 124.

As shown the connector 67 has two pins 124 and there are two corresponding contacts 123 in the electrical connection member 61. FIG. 13 shows that there are four apertures 125, which is to allow for additional electrical connections through the hose inlet 30 if desired. Likewise the connection member 61 has provision for addition of two additional slip rings facing radially outwardly on its peripheral surface and space for two additional contacts.

The use of the slip rings 122 which extend 360° means that the hose connector 67 is rotatable by more than 360 relative to the vacuum cleaner body 1. The number of rotations is unlimited. The cord 112 supplying electric power to the powered head 108 has, as already mentioned, a plug 110 at its end which is received in the socket 109 on the connector 67. The contacts in this socket 109 are connected by lead wires to the pins 124.

As FIG. 16 shows, the socket 109 is mounted in a recessed position in the connector 67 between two left and right cover members 116, 117 which also carry the rectangular lugs which mate with the recesses 31*e* in the socket member 31. Also located in the cover members 116, 117 is a latch member 118 which locks the connector 67 into the socket member 31 by engagement with a slot (not shown) provided in a wall of each of the recesses 31*e*, and is released by finger pressure on a button portion projecting from the cover member 117 (see FIG. 17), thus forming means for quickly connecting and disconnecting the connector 67 with the socket member 31 without use of any tool. If the hose connector 67 is to be sold without the socket 109, the socket 109 can be omitted, and the hole through which the plug 110 is inserted can be covered by a cover member. The adaptation can easily be made, and the portion of the connector 67 providing the space for the socket 109 does not protrude.

The flexible tube 66 is detachably connected to the connector 67 by a sealing ring 113 and a latching ring 114. The hose 66 can rotate in the connector 67.

By these arrangements a very high degree of freedom of movement of the hose 66 is achieved, with little risk of winding of the cord 112 around the hose, or of loose portions of the cord 112 becoming entangled with the user or with furniture.

At its other end the hose 66 is connected by a seal ring 113 and a latching ring 114 to the rigid angle portion 68 which in turn is directly connectable to a cleaning accessory such as the powered head 108 or, as is conventional, extension tubes 69 may be employed.

FIG. 20 shows the cover member 3 in a slightly open position. A latch to lock the cover member 3 in its closed position is constituted by the fixed hook member 131 on the body 1 and the catch member 129 engageable with the hook 131. The catch member 129 can be moved by pressing a release member 128 against a spring 130, to release the latch. FIG. 20 shows that the latch is not engaged and that no dust bag 9 is in place.

Referring now to FIGS. 21 to 23, it can be seen that an obstructor 74 is pivotally mounted by a pivot 74*a* on the inside of the cover 3 adjacent its edge remote from the pivot bar 65. The obstructor 74 is therefore close to the latch 129, 131. The pivot axis of the pivot 74*a* is at right angles to the axis of the hinge of the cover 3 and also at right angles to the front edge of the cover 3. The obstructor 74 has a downwardly projecting triangular tongue 74*c* having an extremity 74*b*. Also on the lower face of the obstructor 74, adjacent the tongue 74*c*, is an abutment surface 74*d*.

A spring 75 acts between the obstructor 74 and the cover 3 to bias the obstructor 74 into the position where the extremity 74*b* is lowermost. If no dust bag is present in the vacuum cleaner, the obstructor 74 prevents full closure of the cover 3 by engagement of the abutment surface 74*d* with the upwardly projecting body rib 36 described above. However, if a dust bag is present, with its cardboard face plate 72 correctly seated upon the seating body rib 133 shown in FIG. 23, the extremity 74*b* of the obstructor 74 engages the face plate 72 during closure of the cover member 3 so that the obstructor 74 is pivoted against the spring force of spring 75, to open a slot 134 which receives the projecting rib 36, allowing the full closure and latching of the cover 3. This safety device, consisting of the obstructor 74 and the rib 36 prevents accidental closure of the cover 3 when no bag is present, and consequent mis-use of the vacuum cleaner.

It should be noted also that if the face plate 72 of the dust bag 9 is incorrectly placed, so that for example it lies upon the rib 36, full closure of the cover 3 will also be prevented by the direct engagement of the cover 3 with the face plate 72.

Adjacent the pivot 74*a* is a shoulder 132 on the cover 3. When the abutment surface 74*d* strikes the rib 36, the force supplied by the user in an attempt to shut the cover 3 is directly transmitted through the obstructor 74 to the shoulder 132, so avoiding excess load on the pivot 74*a*.

The spring force of spring 75 is selected so that, on closure of the cover 3 with the dust bag 9 correctly fitted, the projection 74*c* does not deform the face plate 72 of the bag. However, if the face plate 72 is already damaged or deformed, the obstructor 74 can provide an additional safety feature leading to good operation, if it fails to engage the face plate 72 and therefore prevents the cover 3 from closing.

FIG. 21 shows a slidable door 33, mounted in the cover 3, which can close the hose inlet 30 when the hose is not attached. This is also shown in FIG. 1.

Referring now to FIG. 24, and also to FIGS. 1 and 12, the vacuum cleaner has two identical bypass valves 71 acting in parallel to admit additional external air directly to the dust collection chamber. The electric motor of the blower 7 is cooled by the air sucked by the blower 7 through the dust collection chamber. The valves 71 have outlet heads 80 opening through apertures in the inner cover 76 directly into the dust collection chamber. Extending transversely from the outlet head 80 is a square tube 81 having a valve seat 84 at its other end and containing a valve member 82 pushed against the valve seat 84 by a spring 83 made of coiled wire. The valve member 82 is freely slidable along the tube 81 and has a circular shape with ribs to guide it and provide air passages past it, to allow flow of air along the tube 81 when the valve 71 is opened.

FIG. 24 shows the degree of vacuum (i.e. pressure difference below atmospheric pressure) plotted against the rate of air flow sucked by the blower 7 of the vacuum cleaner across the electric motor, i.e. the amount of air providing cooling of the electric motor. In the absence of the bypass valves 71, the amount of air flow will be related to the degree of vacuum by a smooth curve. The opening of the first of the two bypass valves 71 is indicated by the step in the curve at a predetermined pressure difference $P_A$ below atmospheric pressure. At this step there is a small reduction in the vacuum in the hose 66. If the vacuum in the hose 66 rises further, the second of the two bypass valves 71 opens at a second pressure difference $P_B$ below atmospheric pressure, to admit further external air directly to the dust collection space. Thus at a predetermined level of vacuum, there is a greater amount of cooling air flowing past the motor.

The pressure differences $P_A$ and $P_B$ from atmospheric, at which the two valves 71, open are chosen to be similar. Indeed, the two springs 83 are selected with the same nominal spring force, but due to tolerances they will differ slightly. Consequently one of the two valves 71 will open before the other. Choice of similar spring forces for the two springs 83 results in spaced and sequential opening of the two valves 71, as FIG. 24 indicates. The opening of each valve 71 provides only a small drop of the vacuum in the hose 66, which is acceptable to the user, and the use of a plurality of bypass valves provides sequential increases in the amount of cooling air. Thus overheating of the motor can be avoided, without providing unacceptable loss of vacuum in the hose 66. The same principle applies if more than two bypass valves 71 acting in parallel are provided, having similar opening pressure differences.

It is preferred that the highest opening pressure difference of the plurality of bypass valves 71 is not more than 20% higher than the lowest opening pressure difference of these valves 71, i.e. in the case of two valves 71 $P_A < P_B \leqq 1.2 \times P_A$, where $P_A$ has the lower opening pressure.

What is claimed is:

1. An electric vacuum cleaner having:

a. a body, b. suction generating means and a dust collection space in said body, c. a suction hose having at one end a coupling which is detachably engageable with said body without use of any tool, d. a hose inlet on said body for detachably receiving said coupling of said hose in said hose inlet and connecting said hose to said dust collection space, said hose inlet including means for permitting relative rotation of said hose inlet and said coupling of said hose with respect to said body when said coupling is received in said hose inlet, and e. an electrical power supply cord socket on said coupling of said hose for receiving a plug of a power supply cord for an electrical powered accessory of said electric vacuum cleaner mounted on said suction hose, whereby said coupling of said hose can be detached from said body while maintaining a condition of said coupling at one end of said suction hose on which an electric powered accessory is mounted.

2. An electric vacuum cleaner according to claim 1 wherein said coupling is rotatable by more than 360 relative to said body, when received in said hose inlet.

3. An electric vacuum cleaner according to claim 1, wherein said hose inlet and said coupling have respectively socket and plug components of an electric power conveying plug and socket arrangement wherein said plug is inserted in said socket of the plug and socket arrangement when said coupling is detachably received by said hose inlet whereby electrical power is provided to said cord socket on said coupling.

4. An electric vacuum cleaner according to claim 1 in combination with an accessory connectable to the end of said hose remote from said coupling and including an electrically driven brush, electrical power for said brush being provided by a power supply cord having a plug receivable in said cord socket on said coupling.

5. An electric vacuum cleaner according to claim 1 wherein a suction air flow path through said hose has a bend at said coupling, said cord socket on said coupling being located at an inside of said bend, and an opening of said cord socket is faced in a direction toward said hose.

6. An electric vacuum cleaner according to claim 1 wherein said body has a cover pivotably openable to give access to said dust collection space, said hose inlet being mounted on said cover, whereby when said coupling of said hose is detached from said body, said cover partitions off an inside of said dust collection space and said body outside.

7. An electric vacuum cleaner according to claim 1, wherein said coupling includes means for quickly connecting and disconnecting the coupling with said body without use of any tool.

8. An electric vacuum cleaner according to claim 7, wherein said means for quickly connecting and disconnecting is manually operable.

9. An electric vacuum cleaner according to claim 7, wherein said means for quickly connecting and disconnecting comprises a latch member on said coupling, said latch member being received in a slot in said body for connecting said coupling with said body, and said latch member being manually releasable from said slot for quickly disconnecting said coupling from said body.

10. An electric vacuum cleaner having:

a. a body, b. suction generating means and a dust collection space in said body, c. a suction hose having at one end a coupling which is detachably engageable with said body without use of any tool, d. a hose inlet on said body for detachably receiving said coupling of said hose and connecting said hose to said dust collection space, said hose inlet including means for permitting relative rotation of said hose inlet and said coupling of said hose with respect to said body when said coupling is received in said hose inlet, and e. an electrical power supply cord socket on said coupling of said hose for receiving a plug of a power supply cord for an electrical powered accessory of said electric vacuum cleaner mounted on said suction hose, whereby said coupling of said hose can be detached from said body while maintaining a condition of said coupling at one end of said suction hose on which an electric powered accessory is mounted, wherein said hose inlet and said coupling have respectively socket and plug components of an electric power conveying plug and socket arrangement when said coupling is detachably received by said hose inlet whereby electrical power is provided to said cord socket on said coupling, and wherein said means for permitting relative rotation of said hose inlet includes a plurality of slip rings rotatable relative to said body and contacts engaging said slip rings and fixed relative to said body, for transmission of electric power to said plug and socket arrangement.

11. An electric vacuum cleaner according to claim 10 wherein said hose inlet and said coupling comprise a seal to isolate said slip rings and said plug and socket arrangement from suction air flow.

12. A suction hose for an electric vacuum cleaner having two ends, a coupling at one of said ends for connection of said hose to a hose inlet mounted on and rotatable with respect to a body of said vacuum cleaner, said coupling of said hose being detachably engageable with said body of said vacuum cleaner without use of any tool and further said coupling comprising means for non-rotatably and releasably connecting said coupling to said rotatable hose inlet of the vacuum cleaner with the coupling inserted into the hose inlet so that said coupling of said hose is rotatable with respect to said body of said vacuum cleaner by way of said rotatable hose inlet, an electrical power supply cord socket located on a lower portion of said coupling of said hose, an opening of said cord socket facing in a direction toward said hose, said opening of said cord socket being adapted to receive a plug on an electrical power supply cord, and means engageable with said hose inlet for supply of electrical power from said vacuum cleaner to said cord socket.

* * * * *